US005324105A

United States Patent [19]

Christensen

[11] Patent Number: 5,324,105

[45] Date of Patent: Jun. 28, 1994

[54] STEERING WHEEL STORAGE DEVICE

[75] Inventor: Mark R. Christensen, Adrian, Mich.

[73] Assignee: Arlington Rack and Packaging Company, Toledo, Ohio

[21] Appl. No.: 989,108

[22] Filed: Dec. 11, 1992

[51] Int. Cl.[5] ..... B25H 5/00

[52] U.S. Cl. ..... 312/319.4; 312/327; 206/303; 206/335; 206/587; 211/150

[58] Field of Search ..... 312/313, 319.2, 319.4, 312/327, 328; 206/335, 303, 445, 454, 587; 211/150

[56] References Cited

U.S. PATENT DOCUMENTS

| | | | |
|---|---|---|---|
| 2,218,602 | 10/1940 | Carryl | 312/313 X |
| 2,851,159 | 9/1958 | Budd | 206/335 |
| 2,987,355 | 6/1961 | Sandefur | 312/328 X |
| 3,194,404 | 7/1965 | Wright et al. | 312/328 X |
| 3,934,733 | 1/1976 | Worden | 206/445 X |
| 4,762,689 | 8/1988 | Frey et al. | 206/454 X |
| 4,921,100 | 5/1990 | Krause | 206/335 X |
| 4,921,101 | 5/1990 | Gatt | 206/454 X |
| 5,170,893 | 12/1992 | Smith | 206/445 |

FOREIGN PATENT DOCUMENTS

| | | | |
|---|---|---|---|
| 3843187 | 6/1990 | Fed. Rep. of Germany | 206/454 |
| 0925145 | 8/1947 | France | 211/150 |
| 0299129 | 10/1928 | United Kingdom | 211/150 |
| 1576715 | 10/1980 | United Kingdom | 206/303 |

*Primary Examiner*—Kenneth J. Dorner
*Assistant Examiner*—David E. Allred
*Attorney, Agent, or Firm*—Marshall & Melhorn

[57] ABSTRACT

A storage device including a lid and a plurality of shelf members, pivotally mounted to a frame member. The lid, the base, and the plurality of shelf members form pairs of opposed cooperating rack assemblies. Each pair of cooperating rack assemblies is adapted to hold articles stored in the storage device in an offset nesting relationship until use.

3 Claims, 4 Drawing Sheets

STEERING WHEEL STORAGE DEVICE

BACKGROUND OF THE INVENTION

1. Field of the Invention

This invention relates to storage devices, and more particularly to improved storage devices to temporarily store parts in storage racks ready for transport and eventual use by workers on assembly lines. Most particularly, the present invention relates to an improved storage device to temporarily store automobile steering wheels in storage racks ready for shipment to and installation by automotive assembly line workers in automobiles during the assembly process.

2. Description of the Prior Art

The problem of how to efficiently and safely store a sufficient number of steering wheels beside an automobile assembly line has been present ever since the invention of the automotive assembly line. Current methods now in use are neither space efficient, nor safe.

Currently, storage racks having a number of vertical spindles are used. These storage racks are provided with heavy weighted bases to militate against movement. Vertical rods over which the steering wheel hubs are placed extend upwardly from the bases. A number of steering wheels, alternated with spacers to prevent contact of the wheels with each other, and prevent scuffing, are placed seriatim on the spindles. The spindles may also be mounted on wheeled frames.

When so mounted, due to stacking requirements, they are limited to thirty inches in height. This height limit provides a severe limit to the number of steering wheels which can be place on each rack.

To increase the number of steering wheels that can be stored, the vertical spindles are often times placed in a matrix arrangement, and this poses a serious health problem. As steering wheels are removed from any particular spindle, the worker must reach farther and farther down the spindle to remove the next steering wheel. Since the worker is bending over in the midst of many spindles, frequent eye injuries occur when the worker's head or eye comes in contact with the top of one spindle, while the worker is bending over to pick a steering wheel off another spindle. These accidents are so frequent that this type of device has been referred to in the art as an "eye poker."

In addition, serious ergonomic problems, in the form of back problems, have come about because of all the bending which the worker needs to do, and because of the particular direction of bending. For all these reasons, the search for a safer, more efficient and less expensive method of storing steering wheels next to automotive assembly lines has been one of long standing.

The prior art has revealed many types of racks for storage of many types of parts. Racks, such as those disclosed in U.S. Pat. No. 870,835 to Charles H. Loew, and U.S. Pat. No. 1,856,935 to Giles M. Turner, show racks having a plurality of swingable supports or shelves pivotably mounted on a central frame member. However, even though these devices maintain a plurality of shelves in a parallel spaced relationship, they are not directed to the particular problems associated with steering wheel storage, and do not serve to hold the parts in an offset nesting relationship for easy access by the assembly line worker.

Likewise, patents such as U.S. Pat. Nos. 2,716,495 to C. E. Prevette et al., 2,982,419 to R. A. Shiels, and 3,762,572 to Clarence H. Hager, disclose a plurality of shelf means pivotally supported near their rear edges, and thus, are somewhat similar to the present invention. None of these patents, and in fact no patents found during a search of the prior art, is specifically directed to the problems of steering wheel storage.

SUMMARY OF THE INVENTION

In accordance with the present invention, there is provided a storage device including a lid and a plurality of shelf members, pivotally mounted to a base frame member. The lid and the plurality of shelf members form pairs of cooperating rack assemblies. Each pair of cooperating rack assemblies has article holding means to hold articles stored in the storage device in an offset nesting relationship until use.

Thus, one of the objects of the present invention is to provide an improved steering wheel storage device.

A further object of the present invention is to provide a storage device for use in shipping steering wheels to automobile assembly lines which is safer than previous steering wheel storage devices.

A further object of the present invention is to provide a storage device which is capable of storing steering wheels at a higher density than was heretofore possible.

A still further object of the present invention is to provide an improved steering wheel storage device which reduces bending and fatigue during packing and unpacking, and thus, presents many ergonomic benefits.

Another object of the present invention is the provision of a storage rack which is capable of holding a greater number of articles of manufacture, without increasing the rack size, and which is of durable construction.

Another object of the present invention is to provide an improved storage device having a plurality of pairs of opposing shelf members to hold articles stored between the shelf members in an offset nesting relationship until use.

Further objects and advantages of this invention will be apparent from the following description and appended claims, reference being made to the accompanying drawings forming a part of the specification, wherein like reference characters designate corresponding parts in the several views.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENTS

Figure 1:
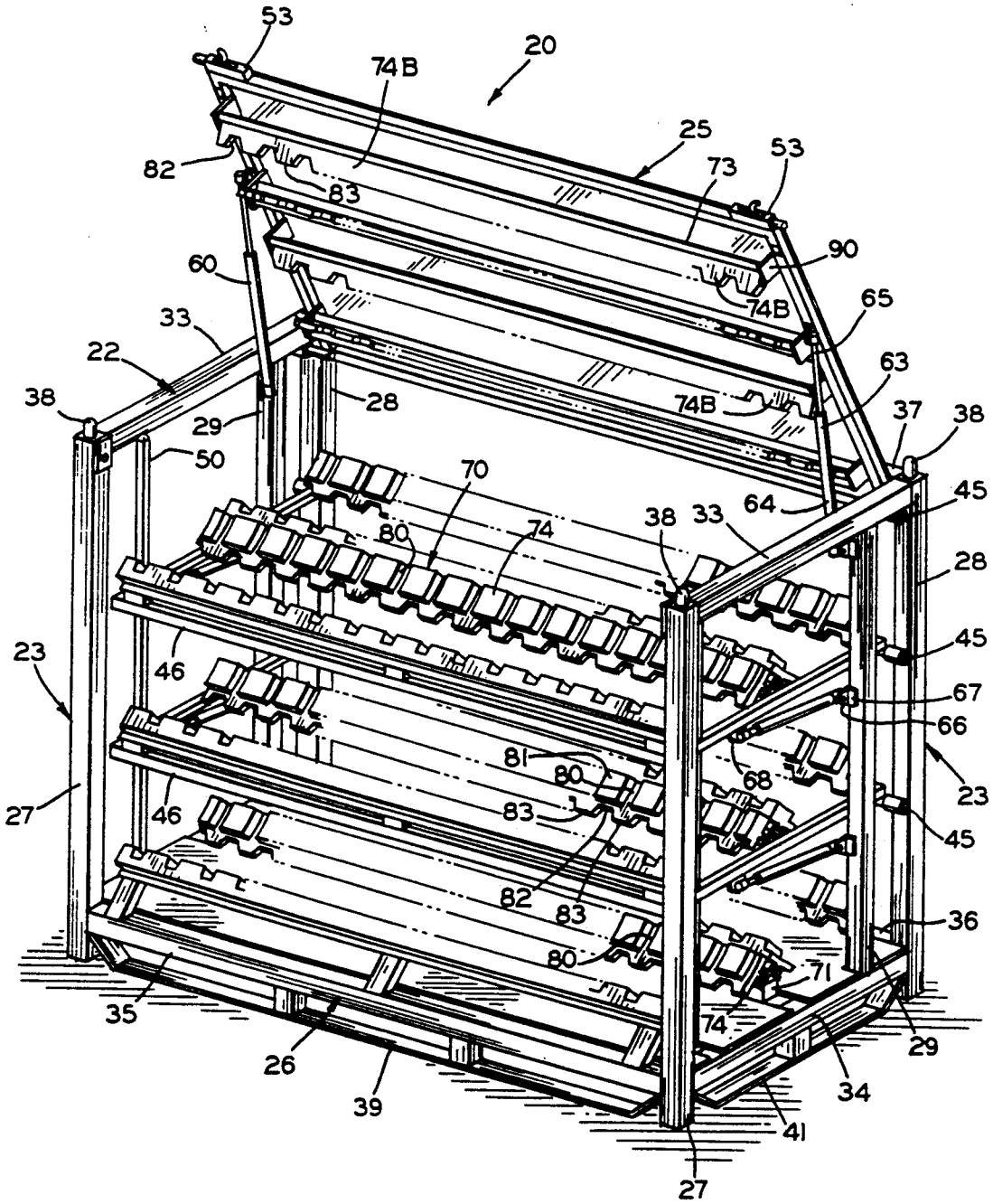
FIG. 1 is a perspective view of a construction embodying the present invention.
Figure 2:
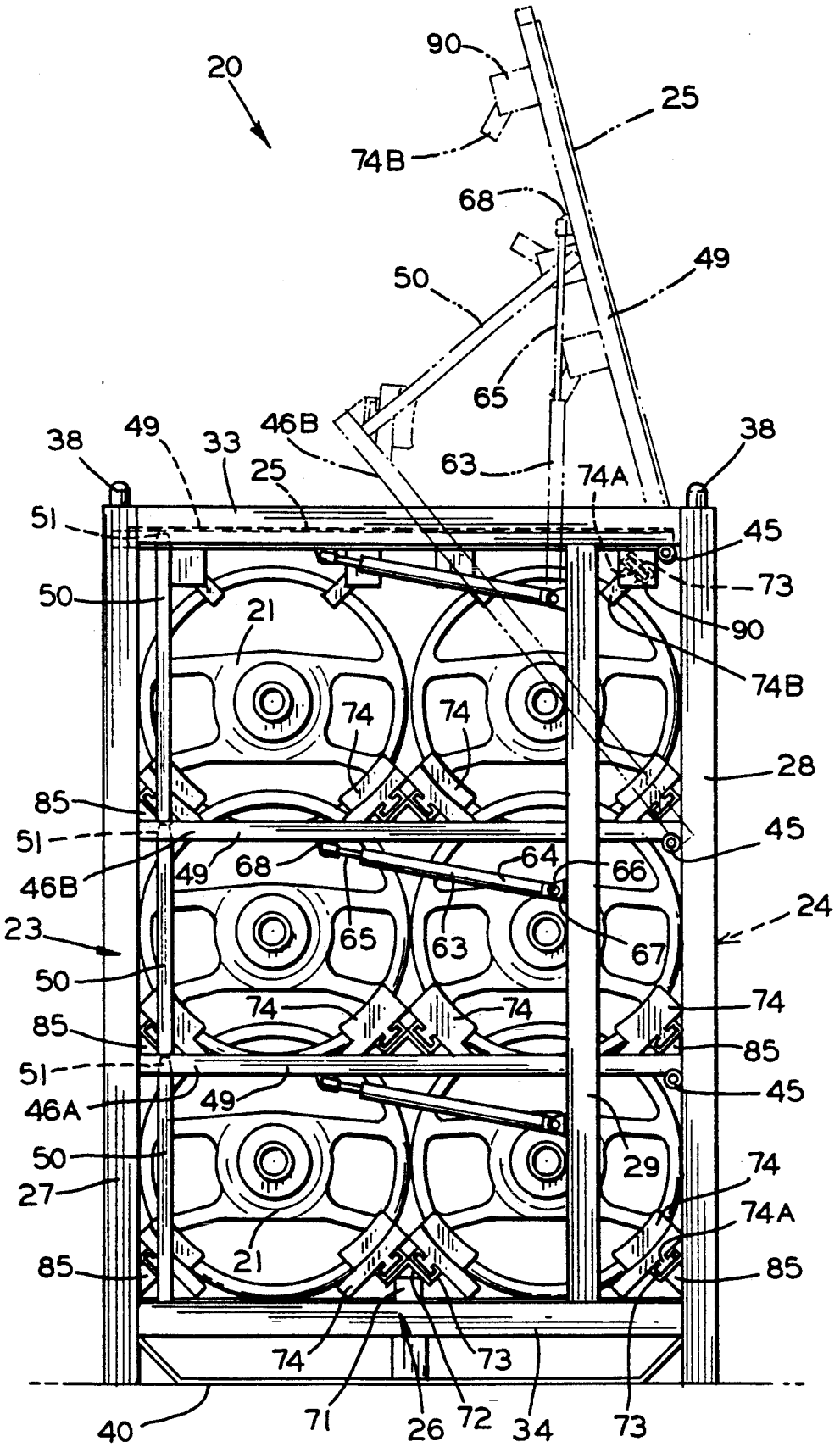
FIG. 2 is a right end view of the construction shown in FIG. 1.
Figure 3:
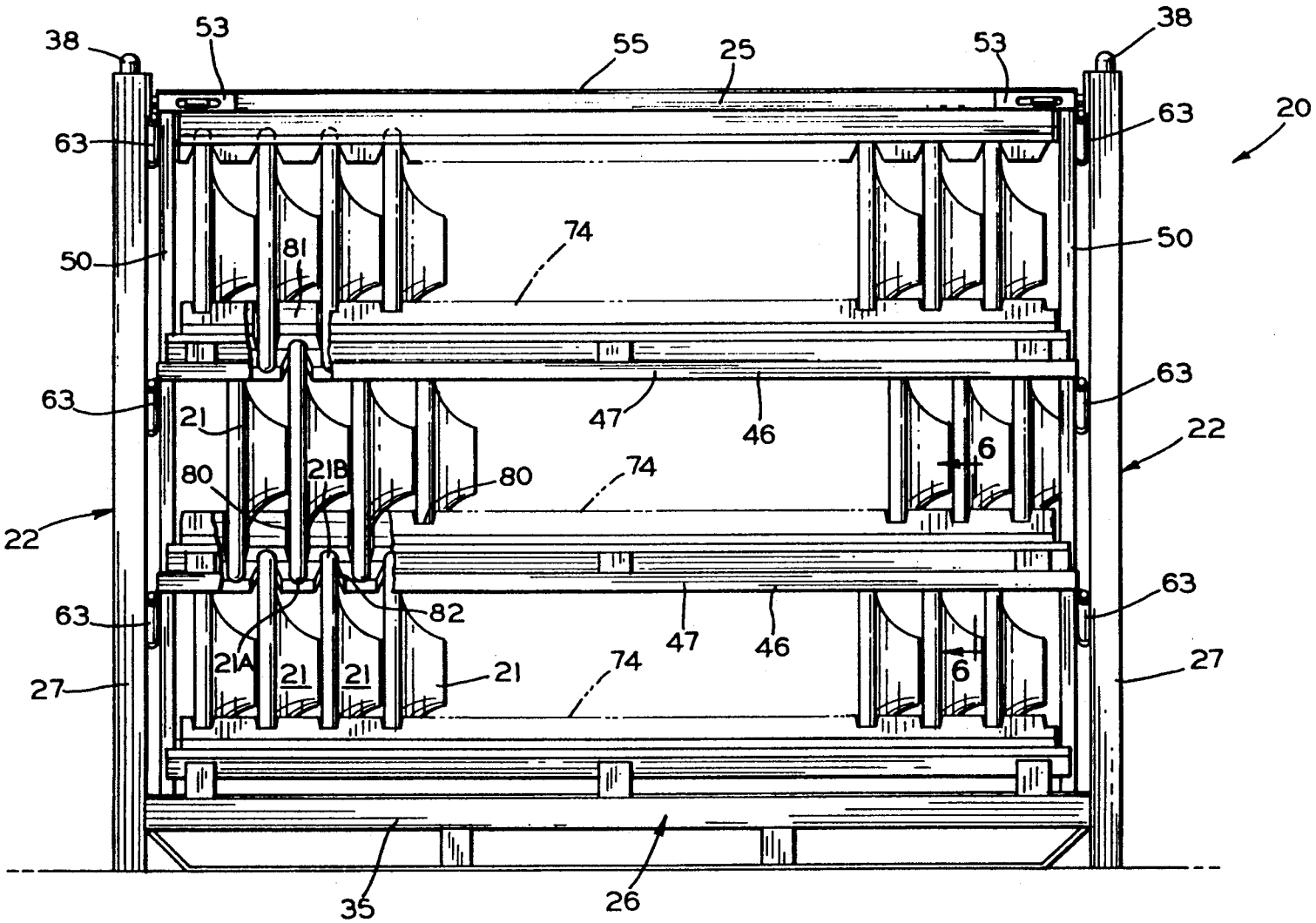
FIG. 3 is a front elevational view of the construction shown in FIG. 1.

Referring to FIGS. 1-3, there is shown an improved steering wheel storage rack 20 embodying the construction of the present invention. The steering wheel storage rack 20 provides storage for a number of steering wheels 21 when desired. The steering wheel storage rack 20 includes a rectangular frame assembly, generally designated by the numeral 22, formed by a pair of opposed side walls 23 connected by a rear wall 24. A hingedly mounted lid 25 closes the top of the frame assembly 22, and is superimposed over the base 26.

Each of the pair of side walls 23 has a front vertical upright 27, a rear vertical upright 28, and an intermediate vertical upright 29. The intermediate vertical upright 29 is spaced forwardly of, and parallel to, the rear vertical upright 28. Each of the side walls 23 is completed by an upper horizontal member 33, and a lower horizontal member 34, attached by any suitable connecting means, such as welding, to the front, rear, and intermediate vertical uprights 27, 28 and 29 respectively.

The frame assembly 22 may be completed by joining or connecting the side walls 23 with a front horizontal member 35 proximate the lower corners of the front vertical uprights 27. This point is at the same height as the lower horizontal members 34 of the side walls 23.

At the same height on the rear vertical uprights 28, a rear lower horizontal member 36 (FIG. 1) is attached, which forms the rectangular base 26. To complete the rectangular frame 22, a rear upper horizontal member 37 connects the side walls 23 at the top of the rear vertical uprights 28.

Stacking pins 38 are provided on the top of the front and rear vertical uprights 27 and 28, respectively, to provide for stacking of the storage racks 20. Front, rear, and side skids 39, 40 and 41, respectively, are provided between the front vertical uprights 27, and the rear vertical uprights 28.

The lid 25 is pivotally or hingedly mounted to the rear vertical uprights 28 by suitable hinge means 45. In its closed position, the lid is superimposed and parallel to the base 26. Since the hinge means 45 are spaced in a 180° opposed relationship, the lid 25 pivots about an axis, which is parallel to and spaced a short distance forwardly of, the rear vertical members 28.

Similarly mounted between the lid 25 and the base 26 are a plurality (preferably two) of shelf members 46. Other attaching or hinge means may be used if desired.

The lid 25, and each of the shelf members 46, has a forward peripheral edge 47, a rear peripheral edge 48, and a pair of side peripheral edges 49. To maintain the lower most shelf member 46A in a parallel spaced relationship with the base 26 when the shelf member 46A is in its closed position, a pair of vertical posts or uprights 50 is mounted proximate the forward end of the lower horizontal members 34 comprising a portion of the base 26. A mating opening 51 in the side peripheral edges 49 of the lower most shelf member engages the pair of uprights when the lower most shelf member 46A is in its closed position. The lower most shelf member 46A and the base 26 form a first opposed pair of cooperating rack assemblies for holding the steering wheels 21 in a manner to be described.

In a manner similar to that described for holding the lower most shelf member 46A in a parallel spaced relationship with the base 26, a further pair of uprights 50 are fixedly mounted to the side peripheral edges 49 of said lower most shelf member 26A and fit in mating openings 51 in the lower edge of the side peripheral edges 49 of the upper most shelf member 46B. The upper most shelf member 46B and the lower most shelf member 46A, form a second pair of opposed cooperating rack assemblies.

The third pair of opposed cooperating rack assemblies is formed by the upper most shelf member 46B and the lid 25 when the lid is in its closed position. In a manner similar to that just described for the upper most shelf member 46B, the lid 25 is held in a parallel spaced relationship by virtue of a further pair of uprights 50 nesting in a mating opening 51 in the lower edge of the side peripheral edges 49 of the lid 25.

To load the steering wheel storage rack 20 with steering wheels 21, whether accomplished at the steering wheel manufacturing plant or at the auto assembly plant from steering wheels supplied in bulk, the operator will first release the latches 53 to lift the lid 25 to its upper most position. The operator will then lift the upper most shelf member 46B to its upper most position. After which, the operator will lift the lower most shelf member 46A to its open position, thus exposing the dunnage 74 spanning the base 26. After the steering wheels are loaded into the grooves 80 in a manner to be hereinafter described, the lower most shelf member 46 is lowered into its closed position. Steering wheels are then loaded until the grooves 80 in the dunnage 74 spanning the lower most shelf member are filled, at which time the upper most shelf member 46B is lowered into its closed position. In a manner similar to that just described, the grooves 80 in the dunnage 74 spanning the upper most shelf member are then filled with steering wheels after which the lid 25 is closed and latched. The steering wheel storage rack is then ready for shipment or use.

After the rack is placed in the desired position by the assembly line, the assembly line worker will make the steering wheels 21 ready for use by opening the latches 53 and raising the lid 25 to the position shown in phantom lines in FIG. 2. The steering wheels 21 will then be removed until the upper most shelf member 46B is completed empty. At that time, the upper most shelf 46B will be raised to its open position, also shown in phantom lines in FIG. 2, where it will be held in a pre-determined position by the uprights 50 coming to rest against the lower edge of the side peripheral edges 49 of the lid 25.

These operations will be repeated by the operator seriatim until the lower shelf member 46A is also raised and comes to rest in its open position.

In order to hold the lid 25 and the shelf members 26 in a raised position when needed, a plurality of spring means 60 are interposed between the lid 25 and the intermediate vertical upright 29, and between each shelf member 46 and the intermediate vertical upright 29. The strength of the spring means 60 is such that when the shelf member 46 is empty, the weight of the shelf and its attendant article holding means, combined with the strength and positioning of the spring means 60, are sufficient to keep the shelf members 46 in their lower position, even with all the steering wheels removed, until the operator applies a slight lifting force thereto, at which time the shelf members will continue to rise on their own.

Because the lid is lighter than the shelf members 46, an additional latch means 53 is provided to keep the lid 25 closed against the force of the spring means 60. The lid 25 is much lighter because the modified article holding means 74B to be described, and the thin cover member 55, together, are much lighter than the article holding means found on the shelf members 46.

The spring means 60 interposed between the lid 25 and the shelf members 46 on the one hand, and the intermediate vertical upright 29 on the other hand, may be in the form of the air spring 63, although other spring means are well within the scope of the invention. The air spring 63, which may be such as Model No. FPN11M 0590N manufactured by Stabilus consists of a cylinder portion 64 in which is slidably fitted for movement a piston (not shown) connected to a piston rod 65. The cylinder portion 64 of the air spring 63 is pivotally mounted by means of a pivot pin 66 to a pivot 67. The piston rod 65 is pivotally mounted by means of a ball joint (not shown) to second pivot 68. The lid 25 and each of the shelf members 46 has a pair of air springs mounted in this manner.

To achieve the desired upward pressure on the shelf and the lid, it has been found desirable to mount the intermediate vertical upright about one foot forward of the rear vertical upright to achieve the correct upward force. It can be seen that depending on the particular steering wheels used, the position of the intermediate vertical upright 29 may be altered, or the intermediate vertical upright 29 may be abolished, and the air springs mounted directly to the rear vertical upright 28. Other parts will require similar adjustments.

Figure 4:
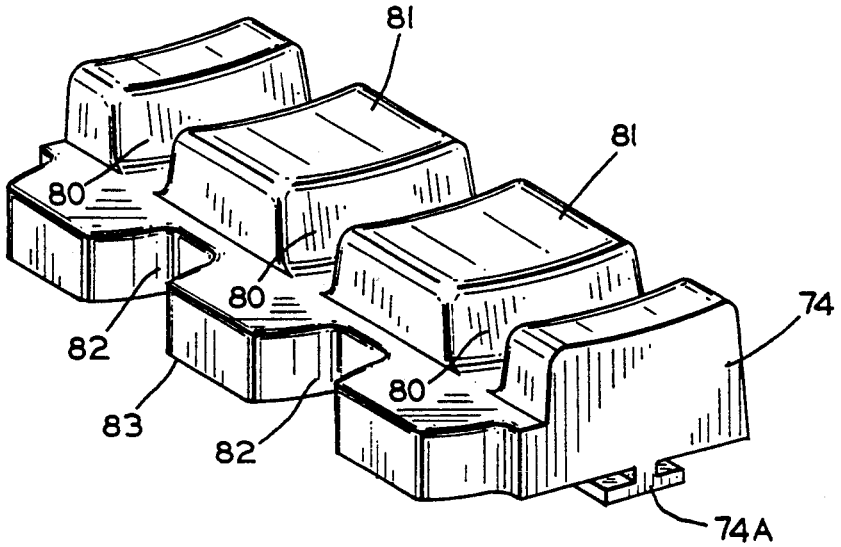
FIG. 4 is a perspective view of one of the article supporting means shown in FIGS. 1–3.
Figure 5:
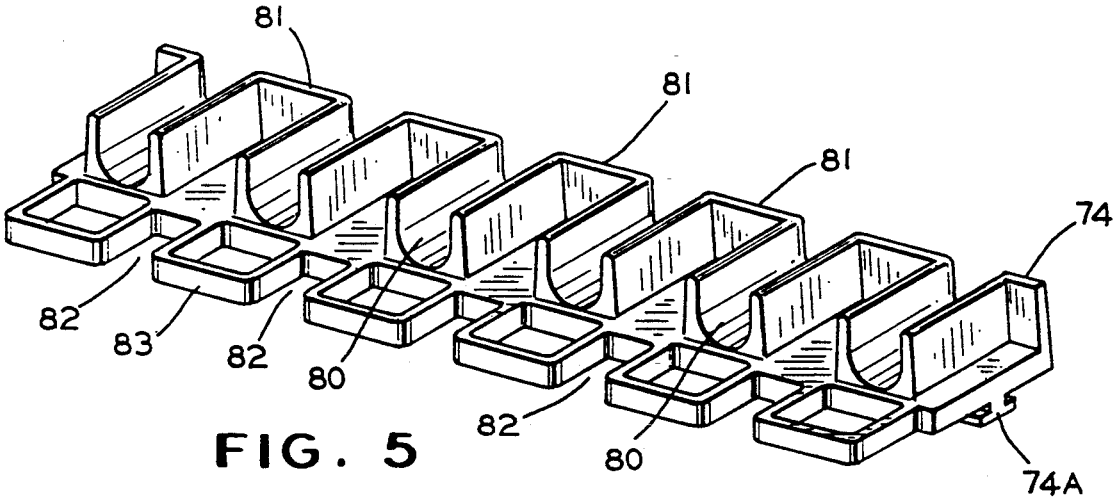
FIG. 5 is a perspective view of a modification of the article supporting means shown in FIG. 4.
Figure 6:
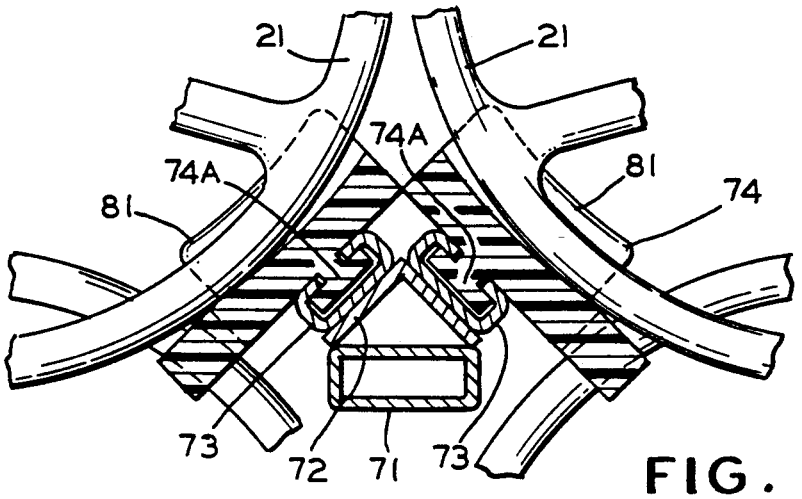
FIG. 6 is a fragmentary sectional view taken along line 6—6 of FIG. 3.

In order to hold the steering wheels in an offset nesting relationship, a plurality of article holding means span the side peripheral edges 49 of the shelf members 46 and the lid 25. Referring to FIGS. 1, 2 and 6, the article holding means, generally designated by the numeral 70, may include such as a box channel 71 spanning the side peripheral edges 49 of the base 26, the lid 25 and the shelf members 46. To the box channel 71 is welded an angle 72, to which are attached a pair of C-shaped channels. A complimentary channel shaped portion 74A of the steering wheel support or dunnage 74 is slipped into each channel 73. Each dunnage 74 forming a portion of the article supporting means 70, whether in the form shown in FIG. 4 made of molded urethane foam, or in the form shown in FIG. 5 made of EVA, has a plurality of notches formed between protuberances 80 for selective reception of a portion of a steering wheel. Each steering wheel supporting means or dunnage 74 also includes a plurality of offset notches 82 formed in the peripheral edge portion 83 of the dunnage 74. Proximate the forward peripheral edges of the shelf members 46 and the base 26, only one C-shaped channel 73 is needed, and this is held at the proper angle by the angle support 85. This arrangement is also used at the rear peripheral edges.

Since the lid requires only the offset notches 82 provided in the peripheral edge portion 73 of the dunnage 74, the dunnage 74 placed in the lid is of a modified form still having the channel-shaped portion 74*a*, but only including a lower portion identified as 74*b* having the offset notches 82 provided in a peripheral edge portion 83. In this case, the channel member 73 is first welded to an angle bracket 90 before being attached to the side peripheral edges 49 of the lid or cover 25.

It can now be understood that by virtue of the offset notches 82 being spaced a distance from the notches 80, and the fact that the distance between the pairs of cooperating rack assemblies is less than the height of the steering wheels 21 being stored, not only are the steering wheels offset during storage as best seen in FIG. 3, but the rim of 21A of a steering wheel stored on an upper pair of cooperating rack assemblies is spaced below the rim 21B of a steering wheel stored on a lower pair of cooperating rack assemblies. Thus, increasing the density at which steering wheels may be stored.

Thus, by carefully studying the problems associated with loading, storage, shipping, and unloading of parts, a novel storage device is provided.

What is claimed is:

1. A storage rack for storing a plurality of steering wheels having rims, including:

a) a generally rectangular frame open at a front and having a pair of opposed side members, a rear member, and a base member, b) a lid hingedly mounted to said frame proximate a top of the rear member and movable between an open position and a closed position, said lid in the closed position, being superimposed over the base member of said frame;

c) a plurality of shelf members hingedly mounted to said frame between said lid and the base member in a parallel spaced relationship, each of said shelf members movable between a closed position superimposed over the base member, and an open position, said lid, said shelf members, and the base member forming opposed pairs of cooperating rack assemblies;

d) article holding means spanning said lid, said shelf members, and the base member of said frame in a longitudinal direction to hold the steering wheels in an offset nesting relationship, said article holding means including dunnage members provided with a plurality of spaced apart notches for selective reception of a portion of a steering wheel rim, a plurality of offset spaced apart notches to engage portions of a steering wheel rim opposed to those received with the spaced apart notches; and e) means for securing the dunnage members of said article holding means to said lid and said shelf members.

2. The storage rack defined in claim 1 wherein said means for securing the dunnage members includes C-shaped channels and complimentary shaped portions on said dunnage members for insertion in said channels.

3. The storage rack defined in claim 1 wherein each of the dunnage members of said article holding means includes a plurality of protrusions spaced seriatim to form said spaced apart notches, and a plurality of recesses provided in a peripheral edge portion of the dunnage members of said article holding means to form the offset notches of said article holding means.

* * * * *